US007488892B2

(12) United States Patent
Belli et al.

(10) Patent No.: US 7,488,892 B2
(45) Date of Patent: Feb. 10, 2009

(54) IMPACT RESISTANT COMPACT CABLE

(75) Inventors: Sergio Belli, Livorno (IT); Fabrizio Donazzi, Milan (IT); Alberto Bareggi, Milan (IT); Cesare Bisleri, Cassina De Pecchi (IT); Carlo Marin, Vigevano (IT)

(73) Assignee: Prysmian Cavi e Sistemi Energia S.R.L., Milan (IT)

( * ) Notice: Subject to any disclaimer, the term of this patent is extended or adjusted under 35 U.S.C. 154(b) by 0 days.

(21) Appl. No.: 10/518,468

(22) PCT Filed: Jun. 5, 2003

(86) PCT No.: PCT/EP03/05913

§ 371 (c)(1),
(2), (4) Date: Aug. 4, 2005

(87) PCT Pub. No.: WO2004/003940

PCT Pub. Date: Jan. 8, 2004

(65) Prior Publication Data

US 2006/0076155 A1 Apr. 13, 2006

(30) Foreign Application Priority Data

Jun. 28, 2002 (WO) ..... PCT/EP02/07167
Sep. 2, 2002 (EP) ..... 02019536

(51) Int. Cl.
*H01B 9/02* (2006.01)

(52) U.S. Cl. ..... 174/105 R; 174/120 R

(58) Field of Classification Search ..... 174/105 R, 174/120 SC, 120 R
See application file for complete search history.

(56) References Cited

U.S. PATENT DOCUMENTS

| | | | | |
|---|---|---|---|---|
| 4,104,210 | A | 8/1978 | Coran et al. | |
| 4,322,260 | A * | 3/1982 | Conlon | 156/244.12 |
| 5,153,381 | A | 10/1992 | Ganatra et al. | |
| 5,231,249 | A * | 7/1993 | Kimura et al. | 174/105 SC |
| 2005/0046073 | A1 * | 3/2005 | Balconi et al. | 264/171.13 |

FOREIGN PATENT DOCUMENTS

EP 0 324 430 A1 7/1989

(Continued)

OTHER PUBLICATIONS

Meurer et al., "Reduced Insulation Thickness for Extruded Medium-Voltage Power Cable Systems- Cable Performance and First Netwrok Applications", 2001 IEEE, pp. 819-824.*

*Primary Examiner*—Chau N Nguyen
(74) *Attorney, Agent, or Firm*—Finnegan, Henderson, Farabow, Garrett & Dunner, L.L.P.

(57) ABSTRACT

A cable for use in a predetermined voltage class, has a conductor; an insulating layer surrounding the conductor, the insulating layer having a thickness selected to provide a predetermined electrical stress when the cable is operated at a nominal voltage in said predetermined voltage class; and a protective element around the conductor having a thickness and mechanical properties selected to provide a predetermined impact resistance capability, the protective element having at least one expanded polymeric layer. The insulating layer thickness and the protective element thickness are selected in combination to minimize the overall cable weight while preventing a detectable insulating layer damage upon impact of 50 J energy. A method for designing a cable is also disclosed.

39 Claims, 5 Drawing Sheets

FOREIGN PATENT DOCUMENTS

| | | | |
|---|---|---|---|
| EP | 0 750 319 | B1 | 12/1996 |
| EP | 0 814 485 | B1 | 12/1997 |
| EP | 0 981 821 | B1 | 3/2000 |
| WO | WO 98/52197 | A1 | 11/1998 |
| WO | WO 99/33070 | A1 | 7/1999 |
| WO | WO 01/46965 | A1 | 6/2001 |

* cited by examiner

IMPACT RESISTANT COMPACT CABLE

CROSS-REFERENCE TO RELATED APPLICATIONS

This application is a national phase application based on PCT/EP2003/005913, filed Jun. 5, 2003, which is incorporated herein by reference in it entirety, and claims the priority of International Application No. PCT/EP02/07167, filed Jun. 28, 2002, and the priority of European Application No. 02019536.8, filed Sep. 2, 2002, both of which are incorporated herein by reference in their entirety.

BACKGROUND OF THE INVENTION

1. Field of the Invention

The present invention relates to a cable, in particular to an electrical cable for power transmission or distribution at medium or high voltage.

More in particular, the present invention relates to an electrical cable which combines high impact resistance and compactness of its design.

In the present description, the term medium voltage is used to refer to a tension typically from about 10 to about 60 kV and the term high voltage refers to a tension above 60 kV (very high voltage is also sometimes used in the art to define voltages greater than about 150 or 220 kV, up to 500 kV or more); the term low voltage refers to a tension lower than 10 kV, typically greater than 100 V.

Furthermore, in the present description the term voltage class indicates a specific voltage value (e.g. 10 kV, 20 kV, 30 kV, etc.) included in a corresponding voltage range (e.g. low, medium or high voltage, or LV, MV, HV).

2. Description of the Related Art

Cables for power transmission or distribution at medium or high voltage generally have a metal conductor which is surrounded, respectively, with a first inner semiconductive layer, an insulating layer and an outer semiconductive layer. In the following of the present description, said predetermined sequence of elements will be indicated with the term of "core".

In a position radially external to said core, the cable is provided with a metal shield (or screen), usually of aluminium, lead or copper, which is positioned radially external to said core, the metal shield generally consisting of a continuous tube or of a metallic tape shaped according to a tubular form and welded or sealed to ensure hermeticity.

Said metal shield has two main functions: on the one hand it provides hermeticity against the exterior of the cable by interposing a barrier to water penetration in the radial direction, and on the other hand it performs an electrical function by creating, inside the cable, as a result of direct contact between the metal shield and the outer semiconductive layer of said core, a uniform electrical field of the radial type, at the same time cancelling the external electrical field of said cable. A further function is that of withstanding short-circuit currents.

In a configuration of the unipolar type, said cable has, finally, a polymeric oversheath in a position radially external to the metal shield mentioned above.

Moreover, cables for power transmission or distribution are generally provided with one or more layers for protecting said cables from accidental impacts which may occur on their external surface.

Accidental impacts on a cable may occur, for example, during transport thereof or during the laying step of the cable in a trench dug into the soil. Said accidental impacts may cause a series of structural damages to the cable, including deformation of the insulating layer and detachment of the insulating layer from the semiconductive layers, damages which may cause variations in the electrical voltage stress of the insulating layer with a consequent decrease in the insulating capacity of said layer.

In the cables which are currently available in the market, for example in those for low or medium voltage power transmission or distribution, metal armours capable of withstanding said impacts are usually provided in order to protect said cables from possible damages caused by accidental impacts. Generally, said armours are in the form of tapes or wires (preferably made of steel), or alternatively in the form of metal sheaths (preferably made of lead or aluminum). An example of such a cable structure is described in U.S. Pat. No. 5,153,381.

European Patent No. 981,821 in the name of the Applicant, discloses a cable which is provided with a layer of expanded polymeric material in order to confer to said cable a high resistance to accidental impacts, said layer of expanded polymeric material being preferably applied radially external to the cable core. Said proposed technical solution avoids the use of traditional metal armours, thereby reducing the cable weight as well as making the production process thereof easier.

European Patent No. 981,821 does not disclose a specific cable core design. In practice, the constitutive elements of the cable core are chosen and dimensioned according to known Standards (e.g. to IEC Standard 60502-2 mentioned in the following of the present description).

According to the present invention, the Applicant observed that the use of an expanded protection of specific design can not only replace other types of protections, but also enable to use a smaller insulation size, thereby obtaining a more compact cable without reducing its reliability.

Moreover, cables for power transmission or distribution are generally provided with one or more layers which ensure a barrier effect to block water penetration towards the interior (i.e. the core) of the cable.

Ingress of water to the interior of a cable is particularly undesirable since, in the absence of suitable solutions designed to plug the water, once the latter has penetrated it is able to flow freely inside the cable. This is particularly harmful in terms of the integrity of the cable as problems of corrosion may develop within it as well as problems of accelerated ageing with deterioration of the electric features of the insulating layer (especially when the latter is made of cross-linked polyethylene).

For example, the phenomenon of "water treeing" is known which mainly consists in the formation of microscopic channels in a branch structure ("trees") due to the combined action of the electrical field generated by the applied voltage, and of moisture that has penetrated inside said insulating layer. For example, the phenomenon of "water treeing" is described in EP-750,319 and in EP-814,485 in the name of the Applicant.

This means, therefore, that in case of water penetration to the interior of a cable, the latter will have to be replaced. Moreover, once water has reached joints, terminals or any other equipment electrically connected to one end of the cable, the water not only stops the latter from performing its function, but also damages said equipment, in most cases causing a damage that is irreversible and significant in economic terms.

Water penetration to the interior of a cable may occur through multiple causes, especially when said cable forms part of an underground installation. Such penetration can occur, for example, by simple diffusion of water through the polymeric oversheath of the cable or as a result of abrasion, accidental impact or the action of rodents, factors that can lead to an incision or even to rupture of the oversheath of the cable and, therefore, to the creation of a preferred route for ingress of water to the interior of the cable.

Numerous solutions are known for tackling said problems. For example, hydrophobic and water swellable compounds, in the form of powders or gel, which are placed inside the cable at various positions depending on the type of cable being considered, can be used.

For example, said compounds may be placed in a position radially internal to the metal shield, more precisely in a position between the cable core and its metal shield, or in a position radially external thereto, generally in a position directly beneath the polymeric oversheath, or in both the aforesaid positions simultaneously.

The water swellable compounds, as a result of contact with water, have the capacity to expand in volume and thus prevent longitudinal and radial propagation of the water by interposing a physical barrier to its free flow. Document WO 99/33070 in the name of the Applicant describes the use of a layer of expanded polymeric material arranged in direct contact with the core of a cable, in a position directly beneath the metallic screen of the cable, and possessing predefined semiconducting properties with the aim of guaranteeing the necessary electrical continuity between the conducting element and the metallic screen.

The technical problem faced in WO 99/33070 was that the covering layers of a cable are continuously subjected to mechanical expansions and contractions due to the numerous thermal cycles that the cable undergoes during its normal use. Said thermal cycles, caused by the diurnal variations in strength of the electric current being carried, which are associated with corresponding temperature variations inside the cable itself, lead to the development of radial stresses inside the cable which affect each of said layers and, therefore, also its metallic screen. This means, therefore, that the latter can undergo relevant mechanical deformations, with formation of empty spaces between the screen and the outer semiconducting layer and possible generation of non-uniformity in the electric field, or even resulting, with passage of time, in rupture of the screen itself. This problem was solved by inserting, under the metallic screen, a layer of expanded polymeric material capable of absorbing, elastically and uniformly along the cable, the aforementioned radial forces of expansion/contraction so as to prevent possible damage to the metallic screen. Furthermore, document WO 99/33070 discloses that, inside said expanded polymeric material, positioned beneath the metallic screen, a water swellable powder material is embedded, which is able to block moisture and/or small amounts of water that might penetrate to the interior of the cable even under said metallic screen.

As it will be recalled in more details in the following of the present description, in the same conditions of electrical voltage applied to a cable, cross-section thereof and insulating material of said cable insulating layer, a decrease of the cable insulating layer thickness causes the electrical voltage stress (electrical gradient) across said insulating layer to increase. Therefore, generally the insulating layer of a given cable is designed, i.e. is dimensioned, so as to withstand the electrical stress conditions prescribed for the category of use of said given cable.

Generally, even though a cable is designed to provide for a thickness of the insulating layer which is larger than needed so that a suitable safety factor is included, an accidental impact occuring on the external surface of the cable can cause a permanent deformation of the insulating layer and reduce, even remarkably, the thickness thereof in correspondence of the impact area, thereby possibly causing an electrical breakdown therein when the cable is energized.

In fact, generally the materials which are typically used for the cable insulating layer and oversheath elastically recover only part of their original size and shape after the impact. Therefore, after the impact, even if the latter has taken place before the cable is energized, the insulating layer thickness withstanding the electric stress is inevitably reduced.

Furthermore, when a metal shield is present in a position radially external to the cable insulating layer, the material of said shield is permanently deformed by the impact, fact which further limits the elastic recover of the deformation so that the insulating layer is restrained from elastically recovering its original shape and size.

Consequently, the deformation caused by an accidental impact, or at least a significant part thereof, is maintained after the impact, even if the cause of the impact itself has been removed, said deformation resulting in the decrease of the insulating layer thickness which changes from its original value to a reduced one. Therefore, when the cable is energized, the real insulating layer thickness which bears the electrical voltage stress (Γ) in the impact area is said reduced value and not the starting one.

SUMMARY OF THE INVENTION

The Applicant has perceived that by providing a cable with a protective element comprising an expanded polymeric layer suitable for conferring to the cable a predetermined resistance to accidental impacts it is possible to make the cable design more compact than that of a conventional cable.

The Applicant has observed that the expanded polymeric layer of said protective element better absorbs the accidental impacts which may occur on the cable external surface with respect to any traditional protective element, e.g. the above mentioned metallic armours, and thus the deformation occurring on the cable insulating layer due to an accidental impact can be advantageously decreased.

The Applicant has perceived that by providing a cable with a protective element comprising an expanded polymeric layer it is possible to advantageously reduce the cable insulating layer thickness up to the electrical stress compatible with the electrical rigidity of the insulating material. Therefore, according to the present invention it is possible to make the cable construction more compact without decreasing its electrical and mechanical resistance properties.

In other words, the Applicant has perceived that, since the deformation of the cable insulating layer is remarkably reduced by the presence of said expanded polymeric layer, it is no longer necessary to provide the cable with an oversized thickness of said insulating layer which ensures a safe functioning of the cable also in the damaged area.

The Applicant has found that, by providing a cable with a protective element comprising an expanded polymeric layer, the thickness of the latter can be advantageously correlated with the thickness of the insulating layer in order to minimize the overall cable weight while ensuring a safe functioning of the insulating layer from an electrical point of view as well as providing the cable with a suitable mechanical protection against any accidental impact which may occur.

Once the cable cross-section conductor, the cable operating voltage and the insulating material of the cable insulating layer are selected and the insulating layer thickness to withstand the electrical voltage stress (Γ) compatible with the dielectric rigidity of the insulating layer material is selected, the Applicant has found that said insulating layer thickness can be correlated with the thickness of the expanded polymeric layer of said protective element. The thickness of said expanded polymeric layer can be selected in order to minimize the deformation of the cable insulating layer upon impact so that a reduced insulating layer thickness can be provided to said cable.

In a first aspect the present invention relates to a cable for use in a predetermined voltage class, said cable comprising:

a conductor;

an insulating layer surrounding said conductor, and a protective element around said insulating layer having a thickness and mechanical properties selected to provide a predetermined impact resistance capability, said protective element comprising at least one expanded polymeric layer, characterized in that:

said insulating layer thickness is such as to provide a voltage gradient on the outer surface of the cable insulating layer not smaller than 1.0 kV/mm, and said protective element thickness is sufficient to prevent a detectable insulating layer damage upon impact of at least 25 J energy.

Preferably, in the case the voltage gradient on the outer surface of the cable insulating layer is not smaller than 1.0 kV/mm and the impact is of at least 25 J energy, said predetermined voltage class is not higher than 10 kV.

Preferably, in the case the voltage gradient on the outer surface of the cable insulating layer is not smaller than 2.5 kV/mm and the impact is of at least 50 J energy, said predetermined voltage class is comprised between 10 kV and 60 kV.

Preferably, in the case the voltage gradient on the outer surface of the cable insulating layer is not smaller than 2.5 kV/mm and the impact is of at least 70 J energy, said predetermined voltage class is higher than 60 kV.

The Applicant has found that the insulation (insulating layer) thickness can be determined by selecting the most restrictive electric limitation to be considered for its intended use, without the need of adding extra thickness to take into account insulation deformations due to impacts.

For example, it is typical to consider in a cable design as significant electric limitations the maximum voltage gradient on the conductor surface (or on the outer surface of the inner semiconductive layer extruded thereon), and the gradient at the joints, i.e. the gradient on the outer surface of the cable insulation.

Preferably, the insulating layer thickness is at least 20% smaller than the corresponding insulating layer thickness provided for in IEC Standard 60502-2. More preferably, the reduction of the insulating layer thickness is comprised in the range from 20% to 40%. Even more preferably, the insulating layer thickness is about 60% smaller than the corresponding insulating layer thickness provided for in said IEC Standard.

Preferably, the thickness of said insulating layer is selected so that the electrical voltage stress within the insulating layer when the cable is operated at a nominal voltage comprised in said predetermined voltage class ranges among values comprised between 2.5 and 18 kV/mm.

Preferably, when said predetermined voltage class is 10 KV, said insulating layer thickness is not higher than 2.5 mm; when said predetermined voltage class is 20 KV said insulating layer thickness is not higher than 4 mm; when said predetermined voltage class is 30 KV said insulating layer thickness is not higher than 5.5 mm.

Preferably, said conductor is a solid rod.

Preferably, the cable further includes an electric shield surrounding said insulating layer, said electric shield comprising a metal sheet shaped in tubular form.

According to a preferred embodiment of the present invention, said protective element is placed in a position radially external to said insulating layer.

Preferably, the degree of expansion of the expanded polymeric layer of said protective element is comprised between 0.35 and 0.7, more preferably between 0.4 and 0.6.

Preferably, the thickness of the expanded polymeric layer of said protective element is comprised between 1 mm and 5 mm In a further aspect of the present invention, the abovementioned protective element further includes at least one non-expanded polymeric layer coupled with said expanded polymeric layer.

In the case an impact on the cable occurs, the Applicant has found that the absorbing (i.e. dumping) function of the expanded polymeric layer is advantageously incremented by associating the latter with at least one non-expanded polymeric layer.

Therefore, according to a preferred embodiment of the present invention, said protective element further comprises a first non-expanded polymeric layer in a position radially external to said expanded polymeric layer.

According to a further embodiment, the protective element of the present invention further comprises a second non-expanded polymeric layer in a position radially internal to said expanded polymeric layer.

Moreover, the Applicant has found that by increasing the thickness of said first non-expanded polymeric layer, while maintaining constant the thickness of the expanded polymeric layer, the mechanical protection provided to the cable by said protective element is advantageously increased.

Preferably, said at least one non-expanded polymeric layer is made of a polyolefin material.

Preferably, said at least one non-expanded polymeric layer is made of a thermoplastic material.

Preferably, said at least one non-expanded polymeric layer has a thickness in the range of 0.2 to 1 mm.

In a further aspect, the Applicant has found that, due to an impact occured on the cable, the deformation of the cable insulating layer is advantageously reduced if the protective element of the present invention is combined with a further expanded polymeric layer provided to the cable in a position radially internal to the protective element.

Furthermore, the Applicant has found that by providing a further expanded polymeric layer in combination with said protective element allows to increase the absorbing (dumping) property of said protective element.

As mentioned above, once an insulating layer thickness has been selected, the combined presence of said expanded polymeric layer of the protective element and of said further expanded polymeric layer enables to obtain substantially the same impact protection with a reduced overall dimension of the cable.

According to a preferred embodiment of the invention, said further expanded polymeric layer is in a position radially internal to said protective element.

Preferably, said further expanded polymeric layer is in a position radially external to said insulating layer.

Preferably, said further expanded polymeric layer is a water-blocking layer and includes a water swellable material.

Preferably, said further expanded polymeric layer is semiconductive.

Preferably, the cable according to the present invention is used for voltage classes of medium or high voltage ranges.

In a further aspect of the present invention, the Applicant has found that, by providing the cable with a protective element comprising at least one expanded polymeric layer, the thickness of said protective element decreases in correspondence with the increase of the conductor cross-sectional area.

Therefore, the present invention further relates to a cable for use in a predetermined voltage class, said cable comprising:

a conductor;

an insulating layer surrounding said conductor, and a protective element around said insulating layer comprising at least one expanded polymeric layer, characterized in that the protective element thickness has a value smaller than 7.5 mm for a conductor cross-sectional area greater than 50 mm and a value greater than 8.5 mm for a conductor cross-sectional area smaller than or equal to 50 $mm^2$.

Preferably, in the case said predetermined voltage class is higher than 60 kV, said insulating layer is not detectably damaged upon impact of an energy of at least 70 J.

Preferably, in the case said predetermined voltage class is not higher than 60 kV, said insulating layer is not detectably damaged upon impact of an energy of at least 50 J.

Preferably, in the case said predetermined voltage class is higher than 10 kV, said insulating layer is not detectably damaged upon impact of an energy of at least 25 J.

If a family (group) of cables suitable for the same voltage class (e.g. 10 kV, 20 kV, 30 kV, etc.) is considered, the Applicant has found that when the cable conductor cross-sectional area increases, the thickness of the cable protective element may advantageously decrease while maintaining substantially the same impact protection. This means that a cable of small conductor cross-sectional area can be provided with a protective element which is thicker than that of a cable having a large conductor cross-sectional area.

Therefore, the present invention further concerns a group of cables selected for a predetermined voltage class and having different conductor cross-sectional areas, each cable comprising:

a conductor;

an insulating layer surrounding said conductor, and a protective element around said insulating layer comprising at least one expanded polymeric layer, wherein the thickness of said protective element is selected in inverse relationship with the conductor cross-sectional area.

Preferably, said protective element further includes at least one non-expanded polymeric layer surrounding said at least one expanded polymeric layer.

Preferably, each cable comprises a further expanded polymeric layer in a position radially internal to said protective element.

According to a further aspect, the present invention further relates to a method for designing a cable comprising a conductor, an insulating layer surrounding said conductor and a protective element surrounding said insulating layer, said protective element including at least one polymeric expanded layer, said method comprising the steps of:

selecting a conductor cross-sectional area;

determining the thickness for said insulating layer compatible with safe operation in a predetermined voltage class on said selected conductor cross-sectional area in correspondence of one of a number of predetermined electrical limit conditions;

selecting the maximum insulating layer thickness among those determined in said number of predetermined electrical limit conditions;

determining a thickness of said protective element so that said insulating layer is not detectably damaged upon an impact is caused on the cable of an energy of at least 50 J, and using said selected insulating layer and said determined protective element thickness in the design of a cable for said predetermined voltage class and selected conductor cross-sectional area.

According to the present invention, a deformation (i.e. a damage) of the cable insulating layer lower or equal to 0.1 mm is considered to be undetectable. Therefore, it is assumed that the cable insulating layer is undamaged in the case a deformation lower than 0.1 mm occurs.

In the case the cable protective element consists of said expanded polymeric layer, the step of determining the thickness of said protective element consists in determining the thickness of said expanded polymeric layer.

In the case the cable protective element further comprises a non-expanded polymeric layers associated with said expanded polymeric layer, the step of determining the thickness of said protective element comprises the step of determining the thickness of said non-expanded polymeric layer.

Preferably, the step of determining the thickness of said non-expanded polymeric layer comprises the step of correlating in inverse relationship the thickness of said non-expanded polymeric layer with the conductor cross-sectional area.

The present invention is advantageously applicable not only to electrical cables for the transport or distribution of power, but also to cables of the mixed power/telecommunications type which include an optical fibre core. In this sense, therefore, in the rest of the present description and in the claims which follow the term "conductive element" means a conductor of the metal type or of the mixed electrical/optical type.

BRIEF DESCRIPTION OF THE DRAWINGS

Further details will be illustrated in the detailed description which follows, with reference to the appended drawings, in which.

DETAILED DESCRIPTION OF THE INVENTION

Figure 1:
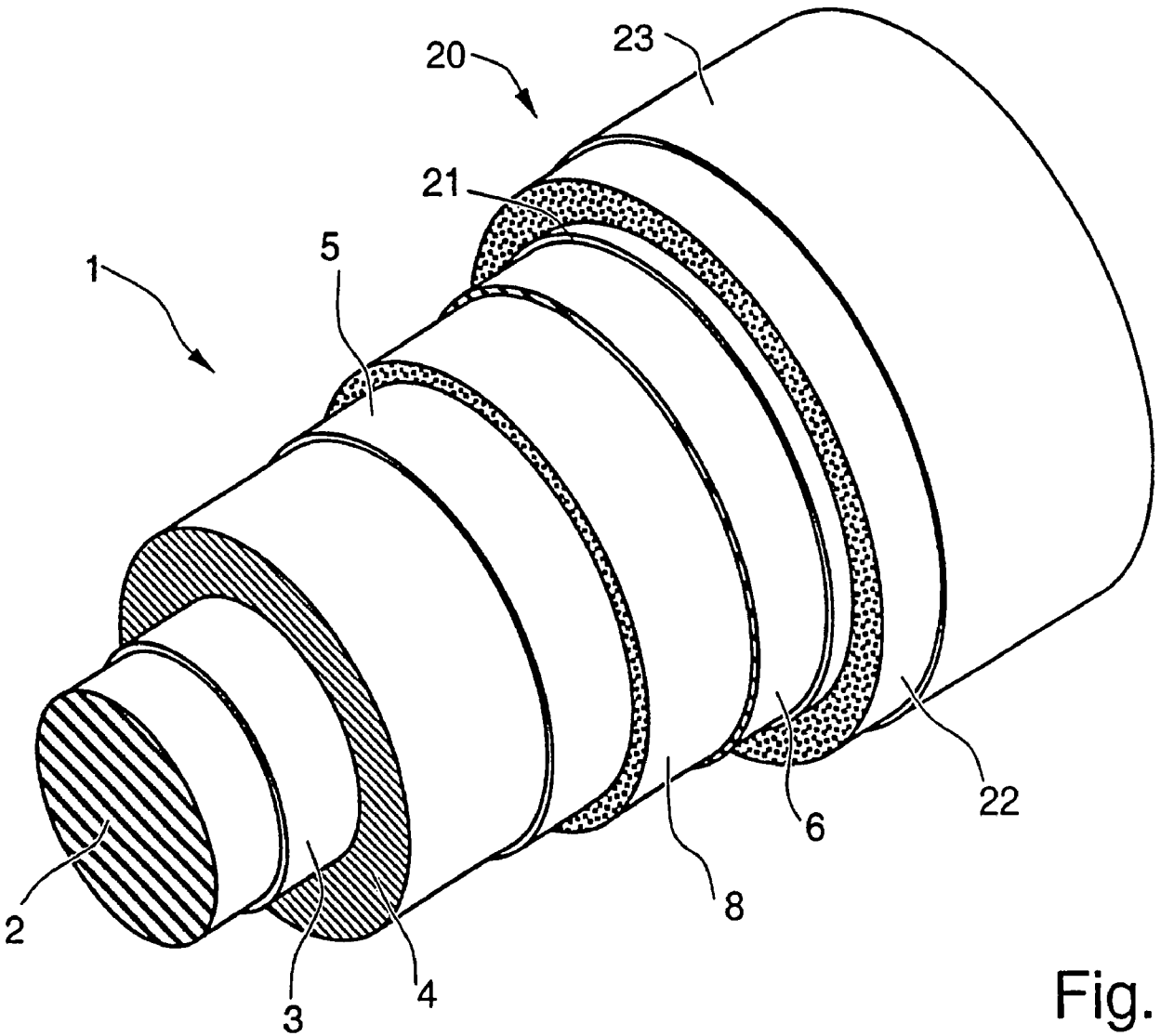
FIG. 1 is a perspective view of an electrical cable, according to the present invention.

FIG. 1 shows a perspective view, partially in cross section, of an electrical cable 1 according to the invention, typically designed for use in medium or high voltage range.

A power transmission cable of the type here described typically operates at nominal frequencies of 50 or 60 Hz.

The cable 1 comprises: a conductor 2; an inner semiconductive layer 3; an insulating layer 4; an outer semiconductive layer 5; a metal shield 6 and a protective element 20.

Preferably, the conductor 2 is a metal rod, preferably made of copper or aluminium. Alternatively, the conductor 2 comprises at least two metal wires, preferably of copper or aluminium, which are stranded together according to conventional techniques.

The cross sectional area of the conductor 2 is determined in relationship with the power to be transported at the selected voltage. Preferred cross sectional areas for cables according to the present invention range from 16 to 1000 $mm^2$.

Generally, the insulating layer 4 is made of a polyolefin, in particular polyethylene, polypropylene, ethylene/propylene copolymers, and the like.

Preferably, said insulating layer 4 is made of a non-crosslinked base polymeric material; more preferably, said polymeric material comprises a polypropylene compound.

In the present description, the term "insulating material" is used to refer to a material having a dielectric rigidity of at least 5 kV/mm, preferably greater than 10 kV/mm. For medium-high voltage power transmission cables, the insulating material has a dielectric rigidity greater than 40 kV/mm.

Preferably, the insulating material of the insulating layer 4 is a non-expanded polymeric material. In the present invention, the term "non-expanded" polymeric material is used to designate a material which is substantially free of void volume within its structure, i.e. a material having a degree of expansion substantially null as better explained in the following of the present description. In particular, said insulating material has a density of 0.85 $g/cm^3$ or more.

Typically, the insulating layer of power transmission cables has a dielectric constant (K) of greater than 2.

The inner semiconductive layer 3 and the outer semiconductive layer 5, both non-expanded, are obtained according to known techniques, in particular by extrusion, the base polymeric material and the carbon black (the latter being used to cause said layers to become semiconductive) being selected from those mentioned in the following of the present description.

In a preferred embodiment of the present invention, the inner and outer semiconductive layers 3, 5 comprise a non-crosslinked base polymeric material more preferably a polypropylene compound.

In the preferred embodiment shown in FIG. 1, the metal shield 6 is made of a continuous metal sheet, preferably of aluminium or, alternatively, copper, shaped into a tube. In some cases, also lead can be used.

The metal sheet 6 is wrapped around the outer semiconductive layer 5 with overlapping edges having an interposed sealing material so as to make the metal shield watertight. Alternatively, the metal sheet is welded.

Alternatively, the metal shield 6 is made of helically wound metal wires or strips placed around said outer semiconductive layer 5.

Usually the metal shield is coated with an oversheath (not shown in FIG. 1) consisting of a crosslinked or non-crosslinked polymer material, for example polyvinyl chloride (PVC) or polyethylene (PE).

According to the preferred embodiment shown in FIG. 1, in a position radially external to said metal shield 6, the cable 1 is provided with a protective element 20. According to said embodiment, the protective element 20 comprises an expanded polymeric layer 22 which is included between two non-expanded polymeric layers, an outer (first) non-expanded polymeric layer 23 and an inner (second) non-expanded polymeric layer 21 respectively. The protective element 20 has the function of protecting the cable from any external impact, occuring onto the cable, by at least partially absorbing said impact.

According to European Patent No. 981,821 in the name of the Applicant, the polymeric material constituting the expanded polymeric layer 22 can be any type of expandable polymer such as, for example: polyolefins, copolymers of different olefins, copolymers of an olefin with an ethylenically unsaturated ester, polyesters, polycarbonates, polysulphones, phenol resins, urea resins, and mixtures thereof. Examples of suitable polymers are: polyethylene (PE), in particular low density PE (LDPE), medium density PE (MDPE), high density PE (HDPE), linear low density PE (LLDPE), ultra-low density polyethylene (ULDPE); polypropylene (PP); elastomeric ethylene/propylene copolymers (EPR) or ethylene/propylene/diene terpolymers (EPDM); natural rubber; butyl rubber; ethylene/vinyl ester copolymers, for example ethylene/vinyl acetate (EVA); ethylene/acrylate copolymers, in particular ethylene/methyl acrylate (EMA), ethylene/ethyl acrylate (EEA) and ethylene/butyl acrylate (EBA); ethylene/alpha-olefin thermoplastic copolymers; polystyrene; acrylonitrile/butadiene/styrene (ABS) resins; halogenated polymers, in particular polyvinyl chloride (PVC); polyurethane (PUR); polyamides; aromatic polyesters such as polyethylene terephthalate (PET) or polybutylene terephthalate (PBT); and copolymers thereof or mechanical mixtures thereof.

Preferably, the polymeric material is a polyolefin polymer or copolymer based on ethylene and/or propylene, and is chosen in particular from:

(a) copolymers of ethylene with an ethylenically unsaturated ester, for example vinyl acetate or butyl acetate, in which the amount of unsaturated ester is generally between 5 and 80% by weight, preferably between 10 and 50% by weight;

(b) elastomeric copolymers of ethylene with at least one $C_3$-$C_{12}$ alpha-olefin, and optionally a diene, preferably ethylene/propylene (EPR) or ethylene/propylene/diene (EPDM) copolymers, generally having the following composition: 35-90% mole of ethylene, 10-65% mole of alpha-olefin, 0-10% mole of diene (for example 1,4-hexadiene or 5-ethylidene-2-norbornene);

(c) copolymers of ethylene with at least one $C_4$-$C_{12}$ alpha-olefin, preferably 1-hexene, 1-octene and the like, and optionally a diene, generally having a density of between 0.86 and 0.90 $g/cm^3$ and the following composition: 75-97% by mole of ethylene; 3-25% by mole of alpha-olefin; 0-5% by mole of a diene;

(d) polypropylene modified with ethylene/$C_3$-$C_{12}$ alpha-olefin copolymers, wherein the weight ratio between polypropylene and ethylene/$C_3$-$C_{12}$ alpha-olefin copolymer is between 90/10 and 10/90, preferably between 80/20 and 20/80.

For example, the commercial products Elvax® (Du Pont), Levapren® (Bayer) and Lotryl® (Elf-Atochem) are in class (a), products Dutral® (Enichem) or Nordel® (Dow-Du Pont) are in class (b), products belonging to class (c) are Engage® (Dow-Du Pont) or Exact® (Exxon), while polypropylene modified with ethylene/alpha-olefin copolymers are commercially available under the brand names Moplen® or Hifax® (Montell), or also Fina-Pro® (Fina), and the like.

Within class (d), particularly preferred are thermoplastic elastomers comprising a continuous matrix of a thermoplastic polymer, e.g. polypropylene, and fine particles (generally having a diameter of the order of 1-10 μm) of a cured elastomeric polymer, e.g. crosslinked EPR o EPDM, dispersed in the thermoplastic matrix. The elastomeric polymer may be incorporated in the thermoplastic matrix in the uncured state and then dinamically crosslinked during processing by addition of a suitable amount of a crosslinking agent. Alternatively, the elastomeric polymer may be cured separately and then dispersed into the thermoplastic matrix in the form of fine particles. Thermoplastic elastomers of this type are described, e.g. in U.S. Pat. No. 4,104,210 or EP-324,430. These thermoplastic elastomers are preferred since they proved to be particularly effective in elastically absorb radial forces during the cable thermal cycles in the whole range of working temperatures.

For the purposes of the present description, the term "expanded" polymer is understood to refer to a polymer within the structure of which the percentage of "void" volume (that is to say the space not occupied by the polymer but by a gas or air) is typically greater than 10% of the total volume of said polymer.

In general, the percentage of free space in an expanded polymer is expressed in terms of the degree of expansion (G). In the present description, the term "degree of expansion of the polymer" is understood to refer to the expansion of the polymer determined in the following way:

$$G(\text{degree of expansion})=(d_0/d_e-1)\cdot 100$$

where $d_0$ indicates the density of the non-expanded polymer (that is to say the polymer with a structure which is essentially free of void volume) and $d_e$ indicates the apparent density measured for the expanded polymer.

Preferably, the degree of expansion of said expanded polymeric layer 22 is chosen in the range from 0.35 and 0.7, more preferably between 0.4 and 0.6.

Preferably, the two non-expanded polymeric layers 21, 23 of said protective element 20 are made of polyolefin materials.

Preferably, the first polymeric non-expanded layer 23 is made of a thermoplastic material, preferably a polyolefin, such as non-crosslinked polyethylene (PE); alternatively, polyvinyl chloride (PVC) may be used.

In the embodiment shown in FIG. 1, cable 1 is further provided with a water-blocking layer 8 placed between the outer semiconductive layer 5 and the metal shield 6.

According to a preferred embodiment of the invention, the water-blocking layer 8 is an expanded, water swellable, semiconductive layer as described in WO 01/46965 in the name of the Applicant.

Preferably, said water-blocking layer 8 is made of an expanded polymeric material in which a water swellable material is embedded or dispersed.

Preferably, the expandable polymer of said water-blocking layer 8 is chosen from the polymeric materials mentioned above.

Said water-blocking layer 8 aims at providing an effective barrier to the longitudinal water penetration to the interior of the cable.

As shown by tests carried out by the Applicant, said expanded polymeric layer is able to incorporate large amounts of water swellable material and the incorporated water-swellable material is capable of expanding when the expanded polymeric layer is placed in contact with moisture or water, thus efficiently performing its water-blocking function.

The water swellable material is generally in a subdivided form, particularly in the form of powder. The particles constituting the water-swellable powder have preferably a diameter not greater than 250 μm and an average diameter of from 10 to 100 μm. More preferably, the amount of particles having a diameter of from 10 to 50 μm are at least 50% by weight with respect to the total weight of the powder.

The water-swellable material generally consists of a homopolymer or copolymer having hydrophilic groups along the polymeric chain, for example: crosslinked and at least partially salified polyacrylic acid (for example the products Cabloc® from C.F. Stockhausen GmbH or Waterlock® from Grain Processing Co.); starch or derivatives thereof mixed with copolymers between acrylamide and sodium acrylate (for example products SGP Absorbent Polymer® from Henkel AG); sodium carboxymethylcellulose (for example the products Blanose® from Hercules Inc.).

To obtain an effective water-blocking action, the amount of water-swellable material to be included in the expanded polymeric layer is generally of from 5 to 120 phr, preferably of from 15 to 80 phr (phr=parts by weight with respect to 100 parts by weight of base polymer).

In addition, the expanded polymeric material of the water-blocking layer 8 can be modified to be semiconductive.

Products known in the art for the preparation of semiconductive polymer compositions can be used to give semiconductive properties to said polymeric material. In particular, an electroconductive carbon black can be used, for example electroconductive furnace black or acetylene black, and the like. The surface area of the carbon black is generally greater than 20 $m^2/g$, usually between 40 and 500 $m^2/g$. Advantageously, a highly conducting carbon black may be used, having a surface area of at least 900 $m^2/g$, such as, for example, the furnace carbon black known commercially under the tradename Ketjenblack® EC (Akzo Chemie Nev.).

The amount of carbon black to be added to the polymeric matrix can vary depending on the type of polymer and of carbon black used, the degree of expansion which it is intended to obtain, the expanding agent, etc. The amount of carbon black thus has to be such as to give the expanded material sufficient semiconductive properties, in particular such as to obtain a volumetric resistivity value for the expanded material, at room temperature, of less than 500 Ω·m, preferably less than 20 Ω·m. Typically, the amount of carbon black can range between 1 and 50% by weight, preferably between 3 and 30% by weight, relative to the weight of the polymer.

A preferred range of the degree of expansion of the water-blocking layer 8 is from 0.4 to 0.9.

Furthermore, by providing cable 1 with a semiconductive water-blocking layer 8, the thickness of the outer semiconductive layer 5 can be advantageously reduced since the electrical property of the outer semiconductive layer 5 is partially performed by said water-blocking semiconductive layer. Therefore, said aspect advantageously contributes to the reduction of the outer semiconductive layer thickness and thus of the overall cable weight.

Electrical Design of the Insulating Layer

Generally, the insulating layer of a cable is dimensioned to withstand the electrical stress conditions prescribed for the category of use of said cable. In particular, when the cable is in operation, the conductor 2 is maintained at the nominal operating voltage of the cable and the shield 6 is connected to earth (i.e. it is at 0 voltage).

Nominally, the inner semiconductive layer 3 is at the same voltage as the conductor and the outer semiconductive layer 5 and the water-blocking layer 8 are at the same voltage as the metal shield 6.

Depending on the insulating layer thickness, this determines an electrical voltage stress across the insulating layer which must be compatible with the dielectric rigidity of the material of the insulating layer (including a suitable safety factor).

The electric voltage stress Γ around a cylindrical conductor is defined by the following formula:

$$\Gamma = U_0 \Big/ \left(r \cdot \ln \frac{r_i}{r_c}\right), \tag{1}$$

$U_o$ is the phase to ground voltage;

$r_i$ is the radius at the insulating layer surface;

$r_c$ is the radius at the conductor surface (or at the surface of the inner semiconductive layer, if present).

The equation (1) refers to the AC voltage regime. A different and more complex expression is available for the CC voltage regime.

For example, the International Standard CEI IEC 60502-2 (Edition 1.1—1998-11—pages 18-19), in case of an insulating layer made of cross-linked polyethylene (XLPE), provides for an insulating layer nominal thickness values of 5.5 mm in correspondence with a voltage V of 20 KV and with a conductor cross-section ranging from 35 to 1000 $mm^2$. As a further example, in case a voltage V of 10 KV and a conductor cross-section ranging from 16 to 1000 $mm^2$ are selected, according to said Standard the cable insulating layer has to be provided with a nominal thickness value of 3.4 mm.

Impact Protection

According to the present invention, the protective element 20 prevents the insulating layer 4 from being damaged by possible impacts due, for example, to stones, tools or the like impacting on the cable during transport or laying operations.

For example, a common practice is to lay a cable in a trench dug in the soil at a predetermined depth, and subsequently to fill the trench with the previously removed material.

In case the removed material includes stones, bricks or the like, it is not uncommon that a piece of a weight of some kilos falls from significant height (many tens of centimetres, up to one metre or more) on the cable, so that the impact involves a relatively high energy.

Other possible sources of impacts during the laying operations are the operating machines, which may hit the cable in case of possible errors, excess of speed etc. in their movements.

Figure 2:
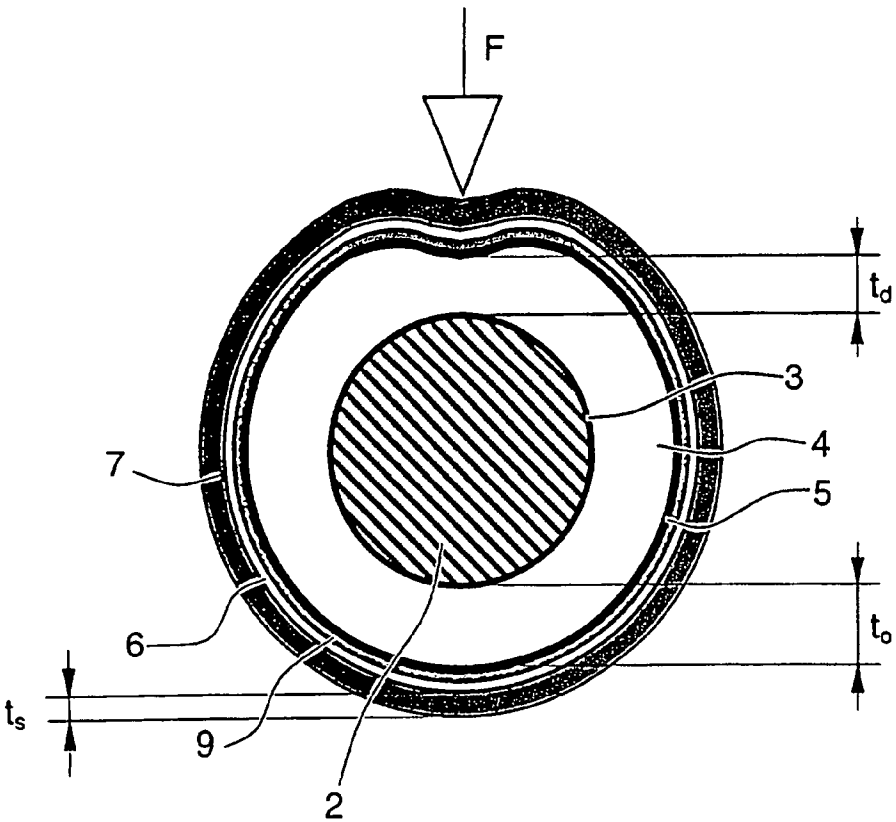
FIG. 2 is a cross-sectional view of a comparative electrical cable, damaged by an impact.

The effects of an impact F on a comparative cable are schematically shown in FIG. 2, where the same reference numerals have been used to identify corresponding elements already described with reference to FIG. 1.

The cable of FIG. 2 is provided with an oversheath 7 positioned outside the metal shield 6. Typically the oversheath 7 is made of a polymeric material, such as polyethylene or PVC.

The cable of FIG. 2 is further provided with a water swellable tape 9 to avoid any longitudinal water penetration to the interior of the cable.

As shown in FIG. 2, as a consequence of the impact F, the cable is locally deformed.

Generally, the materials used for the insulating layer and the oversheath of the cable elastically recover only part of their original size and shape after the impact, so that after the impact, even if it has taken place before the cable is energized, the insulating layer thickness withstanding the electric stress is reduced.

However, the Applicant has observed that, when a metal shield is used outside the cable insulating layer, the material of such shield is permanently deformed by the impact, further limiting the elastic recover of the deformation, so that the insulating layer is restrained from elastically recovering its original shape and size.

Consequently, the deformation caused by the impact, or at least a significant part thereof, is maintained after the impact, even if the cause of the impact itself has been removed. Said deformation results in that the insulating layer thickness changes from the original value $t_0$ to a "damaged" value $t_d$. (see FIG. 2).

Accordingly, when the cable is being energized, the real insulating layer thickness which is bearing the electric voltage stress (Γ) in the impact area is no more $t_0$, but rather $t_d$.

In case the value $t_0$ is selected with sufficient excess, for example as provided for by the Standard cited before, with respect to the operating voltage of the cable, this can still be enough to allow the cable to operate safely also in the impacted zone.

However, the need to allow the safe operation also in a damaged area causes the whole cable to be made with an insulating layer thickness significantly larger than needed.

In addition, if the area of the impact is subsequently involved in some additional operations, for example if a joint is made in such area, conditions may arise where the electric stress is increased more than acceptable (either for the cable or for the associated accessory, which may be working on a diameter different from the one it has been designed for), even if a certain safety excess has been provided in the insulating layer thickness.

Impact Resistance Evaluation

The impact energy has been evaluated in view of the various parameters which have been found relevant to the impact and of the relevant probability for different classes of cables.

For example, in case the impact is caused by an object falling on the cable, the impact energy depends both on the mass of the object impacting upon the cable and on the height from which said object falls down.

Accordingly, when the cable is laid in a trench or the like, the impact energy depends, among other factors, on the depth at which the cable is laid, said impact energy increasing with the depth.

Accordingly, it has been found that the impact energy is different for different classes of cables in accordance with their respective depths of lay. Furthermore, for cables laid in a trench or the like, the presence of excavation debris, which are generally involved during the laying operations, affects the probability of an accidental impact on the cable and their size contributes to determine the energy of a possible impact. Other factors, such as the unitary weight of the cable and the size of the operating machines used in the laying operations have also been considered.

In view of the analysis above, for each class of cables (e.g. LV, MV, HV), reference impacts energies have been identified as having a significant probability of occurrence; in correspondence of these impacts, a particular cable structure has been defined as capable to support such impacts.

In particular, for a MV cable an impact of energy of 50 J has been identified as representative of a significant event in the cable use and laying.

Such impact energy can be achieved, for example, by allowing a conically shaped body of 27 kg weight to fall from a height of 19 cm on the cable. In particular, the test body has an angle of the cone of 90°, and the edge is rounded with a radius of about 1 mm.

In the present description, the term "impact" is intended to encompass all those dynamic loads of a certain energy capable to produce substantial damages to the structure of the cables.

For cables for low voltage and high voltage applications (LV, HV) impact energies of 25 J and 70 J respectively have been identified.

To the purposes of the present invention, it has been considered that the cable is satisfactorily protected if a permanent deformation smaller than 0.1 mm (which is the precision limit of the measurement) after 4 subsequent impacts in the same position has occurred.

Figure 3:
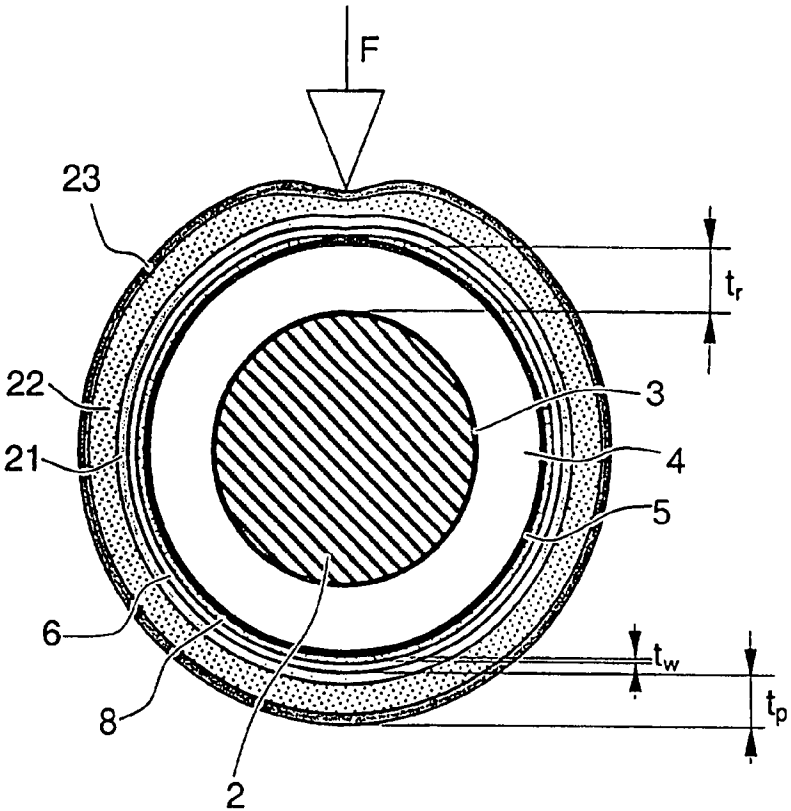
FIG. 3 is a cross-sectional view of an electrical cable, according to the present invention, in the presence of protective element deformation caused by an impact.

When an impact is caused against a cable according to the present invention, as shown in FIG. 3, the protective element 20, either alone, or, preferably, in combination with the expanded water-blocking layer 8, is capable of reducing the deformation of the insulating layer 4.

According to the present invention it has been found that a protective element 20 having a thickness $t_p$, combined with an insulating layer thickness selected at a "reduced" value $t_r$, can result in a cable which can satisfactorily pass the impact resistance test indicated before, still maintaining the capability of safely operating in the selected voltage class. The insulation thickness can be determined by selecting the most restrictive electric limitation to be considered for its intended use, without the need of adding extra thickness to take into account deformations due to impacts.

For example, it is typical to consider in a cable design as significant electric limitations the maximum gradient on the conductor surface (or on the outer surface of the inner semiconductive layer extruded thereon), and the gradient at the joints, i.e. the gradient on the outer surface of the cable insulation.

The gradient on the conductor surface is compared with the maximum acceptable gradient of the material used for the insulation (e.g. about 18 kV/mm in the case of polyolefin compounds) and the gradient at the joints is compared with the maximum acceptable gradient of the joint device which is envisaged for use with the cable.

For example, a cable joint can be made by replacing the insulation on the conductor joining area with an elastic (or thermo-shrinking) sleeve, which overlaps for a certain length the exposed cable insulation layer.

In case such type of joints can safely operate with a gradient of about 2.5 kV/mm (for a MV cable), this is likely to be the most restrictive condition and the insulation thickness is determined to withstand such condition. In case another condition may turn out to be more restrictive, such condition shall be take into account for the insulation thickness design.

According to the present invention, however, no extra thickness has to be provided to take into account insulation deformation caused by impacts.

It has also been found that, when the protective element 20 is used in combination with an insulating layer thickness selected at a "reduced" value $t_r$, the overall cable weight is lower than the corresponding weight of a cable without impact protection (i.e. without an impact protective element comprising an expanded polymeric layer) and with a traditional insulating layer thickness $t_0$ (i.e. the cable of FIG. 2), capable of resisting to the same impact energy (even if by admitting a deformation of the insulating layer). The presence of an expanded water-blocking layer 8 has also been found to further contribute to the impact resistance, allowing to further reduce the deformation of the insulating layer 4.

Insulating layer thickness and overall cable weights for two cables according to the present invention as well as for a comparative cable (whose design gets through the impact resistance test described above) are shown in Table 1, for 20 kV class voltage cables and conductor cross-section of 50 $mm^2$.

TABLE 1

| | Thickness (mm) | | | | | | | | | |
|---|---|---|---|---|---|---|---|---|---|---|
| | | Protective element | | | Water | | | | | |
| Cable Type | Oversheath | Second (inner) non-expanded layer | Expanded layer | First (outer) non-expanded layer | blocking expanded layer | Water swellable tapes | Aluminum metallic screen | Isulating layer | Cable weight (kg/m) | Overall diameter (mm) |
| 1 | — | 1 | 1.5 | 4.4 | — | 0.15 | 0.3 | 4 | 0.74 | 30.7 |
| 2 | — | 1 | 1.5 | 0.85 | 0.5 | — | 0.3 | 4 | 0.51 | 24.9 |
| 3 | 8.25 | — | — | — | — | 0.2 | 0.3 | 4 | 0.90 | 33.9 |

In details:

a) Cable 1 is a cable of the present invention comprising a non-expanded water-blocking layer 8 made of water swellable tapes, said cable further comprising a protective element 20 including: a first non-expanded polymeric layer 23; an expanded polymeric layer 20; a second non-expanded polymeric layer 21;

b) Cable 2 is a cable of the present invention comprising an expanded water-blocking layer 8, said cable further comprising a protective element 20 including: a first non-expanded polymeric layer 23; an expanded polymeric layer 22; a second non-expanded polymeric layer 21;

c) Cable 3 is a comparative cable of the type shown in FIG. 2 comprising: an oversheath and a water swellable blocking layer made of water swellable tapes.

Furthermore, Table 1 shows that in the case an expanded water-blocking layer 8 is provided, the thickness of the protective element 20 is advantageously reduced (and the overall cable weight is decreased) maintaining the same insulating layer thickness.

Moreover, Table 1 shows that the comparative cable would have required a remarkable weight (i.e. of about 0.90 kg/m) to maintain its operability in the same impact conditions in comparison with the cables of the present invention.

Table 2 contains examples of insulating layer dimensions for cables according to the present invention for different operating voltage classes in the MV range, compared with the corresponding insulating layer thickness prescribed by the above cited International Standard CEI IEC 60502-2, for cross-linked polyethylene (XLPE) insulating layer.

TABLE 2

| | 10 kV | 20 kV | 30 kV |
|---|---|---|---|
| Insulating layer thickness (mm) of a cable of the invention | 2.5 | 4 | 5.5 |
| Insulating layer thickness (mm) according to Standard CEI IEC 60502-2 | 3.4 | 5.5 | 8 |

According to the values reported in Table 2, the insulating layer thickness provided to a cable of the present invention is 26%, 27% and 56% smaller than the corresponding insulating layer thickness according to said Standard respectively.

Impact Protective Element Dimension

The protective element dimension has been evaluated for different cable sections in order to provide the absence of deformation to the insulating layer for the different conductor sections.

To this purpose, the thickness of a protective element corresponding to insulating layer deformation ≦0.1 mm upon impact of 50 J energy has been determined in correspondence of various conductor cross-sectional areas, both in case of presence of an expanded water-blocking layer and in case of presence of a non-expanded water-blocking layer.

The protective element thickness has been varied by maintaining constant the thickness of the second non-expanded layer 21 and of the expanded polymeric layer 22, while increasing the thickness of the first non-expanded layer 23.

Figure 4:
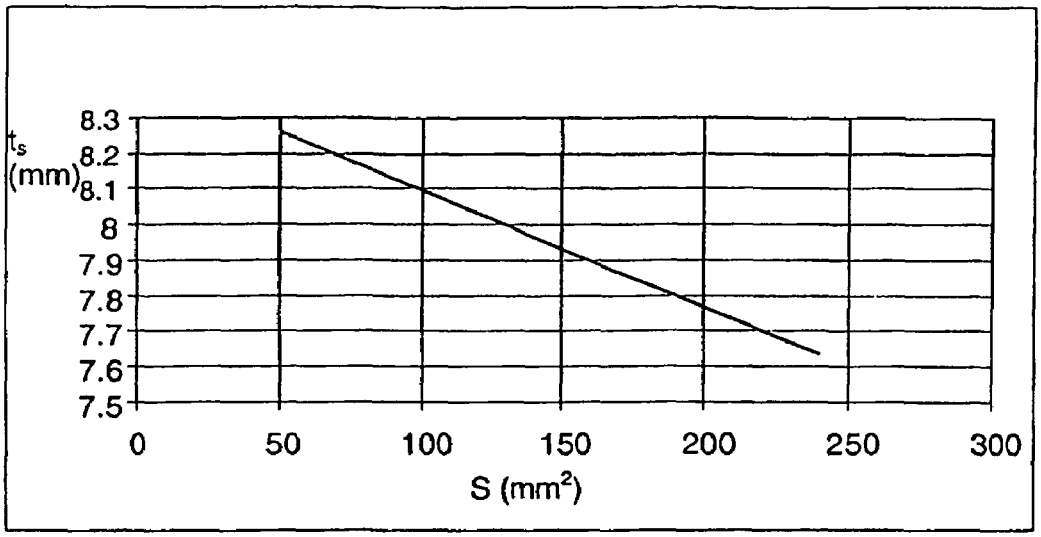
FIG. 4 is a graph showing the relationship between the thickness of the oversheath and the conductor cross-sectional area as designed to prevent insulating layer damage upon impact in a traditional cable.

The corresponding thickness of a non-expanded oversheath 7 has also been selected for cables not provided with said protective element 20 (see FIG. 4).

Figure 5:
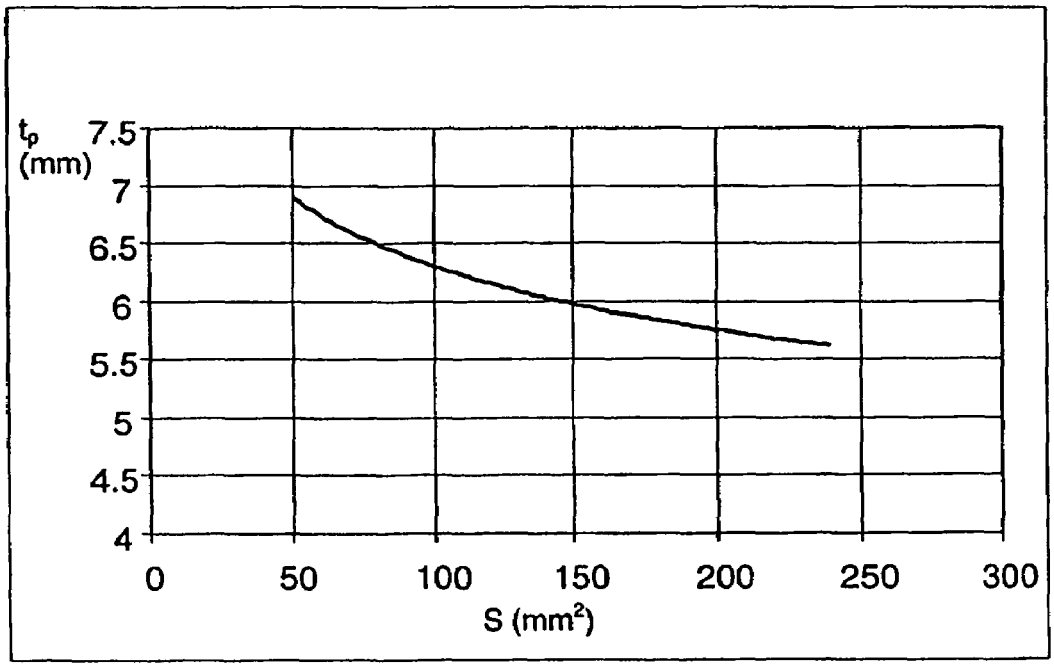
FIG. 5 is a graph showing the relationship between the thickness of the cable protective element and the conductor cross-sectional area as designed to prevent insulating layer damage upon impact in the cable in accordance with the present invention.
Figure 7:
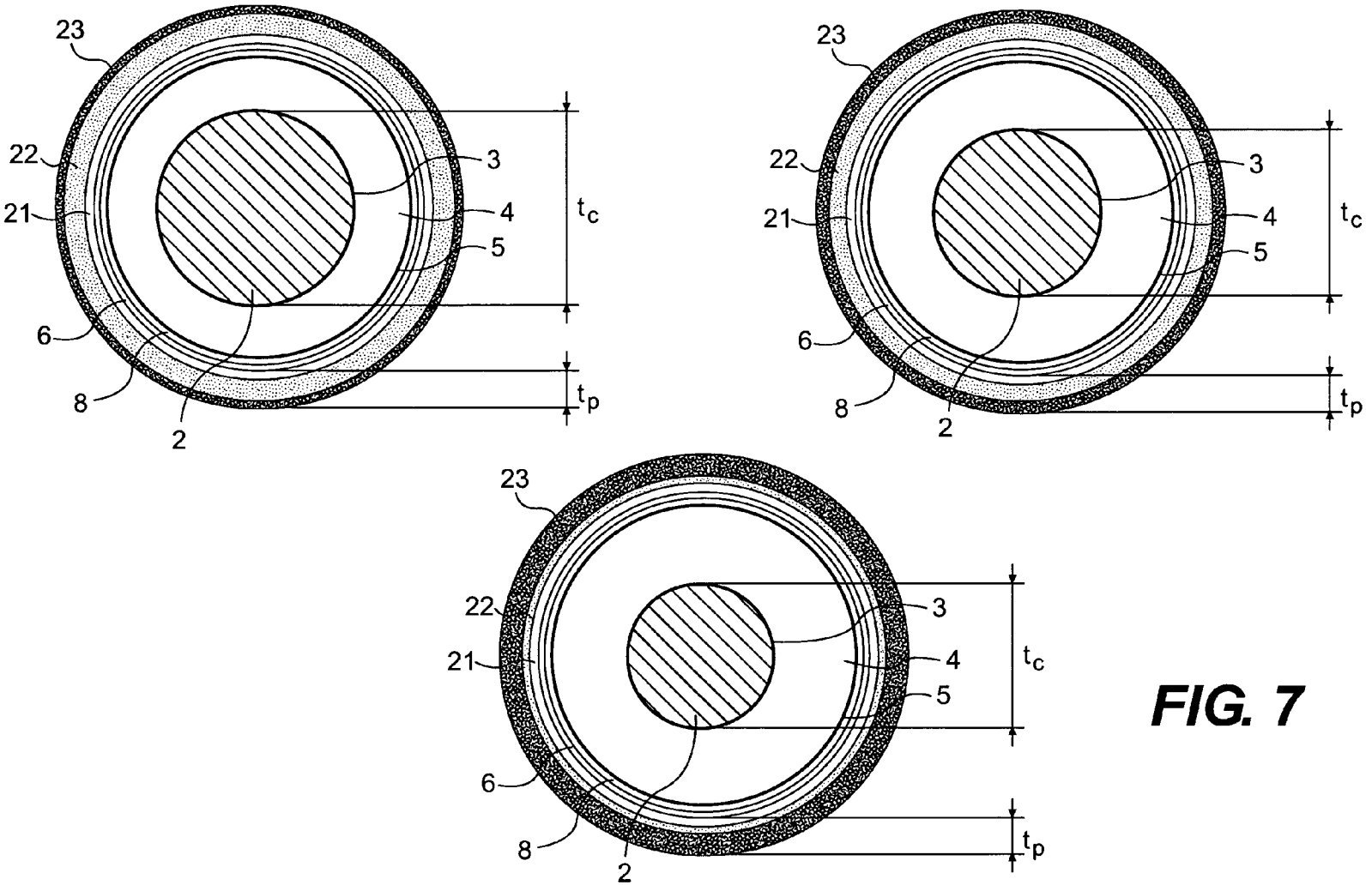
FIG. 7 is a cross-sectional view of a group of electrical cables according to one version of the present invention.

It has been found that the thickness of said protective element decreases in correspondence with the increase of the conductor cross-sectional area (see FIG. 5). FIG. 7 shows a group of cables 100, 200, 300 according to one version of the present invention selected for a predetermined voltage class. Each of cables 100, 200, 300 includes a conductor 2 having a different cross-sectional area, an insulating layer 4 surrounding the conductor, and a protective element around said insulating layer comprising a protective element 20. Protective element 20 includes expanded polymeric layer 22 between an outer (first) non-expanded polymeric layer 23 and an inner (second) non-expanded polymeric layer 21. In each cable 100, 200, 300, the thicknesses of the protective element 20 is in inverse relationship with the conductor cross-sectional area. Thus, cable 100, which has the largest conductor cross-sectional area of cables 100, 200, 300, also has the thinnest protective element 20. In each of the cables 100, 200, 300, the thickness of expanded polymer layer 21 is constant, while the thickness of at least one of non-expanded polymeric layers 21, 23 varies depending on the conductor cross-sectional area.

Figure 6:
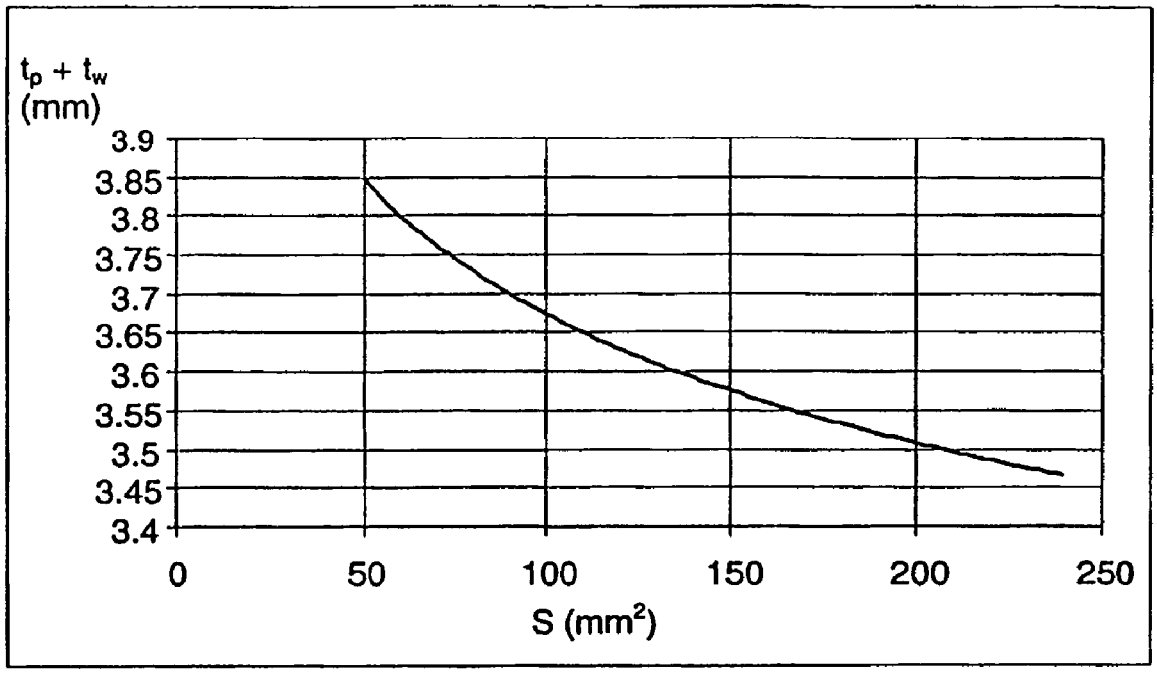
FIG. 6 is a graph showing the relationship between the thickness of the protective element and the conductor cross-sectional area as designed to prevent insulating layer damage upon impact in a cable provided with two expanded polymeric layers according to the present invention.

It has also been found that the presence of an expanded water-blocking layer 8 allows to use a significantly thinner protective element 20 (see FIG. 6 in comparison with FIG. 5).

The results are shown in FIGS. 4, 5, 6, respectively for a comparative cable with an oversheath 7, a cable with the protective element 20, and a cable with both the protective element 20 and the expanded water-blocking layer 8.

In said figures, the oversheath thickness $t_s$ with reference to FIG. 4, the protective element thickness $t_p$ with reference to FIG. 5, and the sum of the protective element thickness $t_p$ and of the water-blocking layer thickness $t_w$ with reference to FIG. 6, are plotted in function of conductor cross-sectional area S for the 20 kV voltage class.

The Applicant has also been found that the increase of the mechanical protection against impacts is obtained by increasing the first non-expanded layer thickness, while maintaining constant the expanded polymeric layer thickness.

The cable of the present invention is particularly suitable for use in the medium and high voltage field, in view of the electrical and mechanical stress conditions to be faced in these fields.

However, it can be used also in low voltage applications whenever the situation (e.g. severe electrical and mechanical stress, safety or reliability requirements etc.) so requires.

According to the present invention, as mentioned above, by providing the cable with an expanded polymeric layer makes it possible to advantageously decrease the overall cable weight.

Said aspect is very important since it reflects in greater ease of transport, and consequently in reduced transport costs, as well as in easier handling of the cable during the laying step. In this respect it is worthwhile emphasising that the less the overall weight of the cable to be installed (for example directly in a trench excavated into the ground or in a buried piping), the less will be the pulling force which is necessary to be applied to the cable in order to install it. Therefore, this means both lower installation costs and greater simplicity of the installation operations.

Furthermore, according to the present invention a more compact cable can be obtained while maintaining the desired mechanical and electrical properties of the cable. Thanks to said aspect greater lengths of cable can be stored on reels, thereby resulting in the reduction of the transport costs and of splicing operations to be carried out during the laying of the cable.

The invention claimed is:

1. A method for designing a cable comprising a conductor, an insulating layer surrounding said conductor and a protective element surrounding said conductor, said protective element including at least one polymeric expanded layer, comprising the steps of:

selecting a conductor cross-sectional area;

selecting a voltage class for the cable;

determining a correlation between a thickness of said protective element and a thickness of said insulating layer so as to ensure the safe operation of the cable in the selected voltage class on said selected conductor cross-sectional area and that the cable is not detectably damaged upon an impact on the cable by an energy of at least 25 J;

selecting a thickness of said protective element;

selecting a correlated thickness of said insulating layer;

using said selected insulating layer thickness and said selected protective element thickness in the design of the cable for said selected voltage class and selected conductor cross-sectional area.

2. The method according to claim 1, wherein said selected voltage class is not higher than 10 kV.

3. The method according to claim 1, wherein said impact is of at least 50 J energy.

4. The method according to claim 3, wherein said selected voltage class is between 10 kV and 60 kV.

5. The method according to claim 1, wherein said impact is of at least 70 J energy.

6. The method according to claim 5, wherein said selected voltage class is higher than 60 kV.

7. The method according to claim 1, wherein said insulating layer thickness is at least 20% smaller than the insulating layer thickness provided for in IEC Standard 60502-2 (Ed. 1.1—1998-11) for the corresponding voltage class.

8. The method according to claim 1, wherein said selected voltage class is 10 KV and said insulating layer thickness is not higher than 2.5 mm.

9. The method according to claim 1, wherein said predetermined voltage class is 20 KV and said insulating layer thickness is not higher than 4 mm.

10. The method according to claim 1, wherein said selected voltage class is 30 KV and said insulating layer thickness is not higher than 5.5 mm.

11. The method according to claim 1, wherein said conductor is a solid rod.

12. The method according to claim 1, wherein the cable further comprises an electric shield surrounding said insulating layer, said electric shield comprising a metal sheet shaped in tubular form.

13. The method according to claim 1, wherein said insulating layer thickness is selected so that the electrical stress within the insulating layer when the cable is operated at a voltage corresponding to said selected voltage class ranges among values between 2.5 and 18 kV/mm.

14. The method according to claim 1, wherein said protective element is placed in a position radially external to said insulating layer.

15. The method according to claim 1, wherein the degree of expansion of said expanded polymeric layer is between 0.35 and 0.7.

16. The method according to claim 15, wherein said degree of expansion is between 0.4 and 0.6.

17. The method according to claim 1, wherein said expanded polymeric layer has a thickness between 1 and 5 mm.

18. The method according to claim 1, wherein an expandable polymeric material of said expanded polymeric layer is selected from polyolefin polymers or copolymers based on ethylene and/or propylene.

19. The method according to claim 18, wherein said expanded polymeric material is selected from:

a) ethylene copolymers with an ethylenically unsaturated ester in which the quantity of unsaturated ester is between 5% and 80% by weight, b) elastomeric copolymers of ethylene with at least one $C_3$-$C_{12}$ α-olefin, and optionally a diene, having the following composition: 35%-90% as moles of ethylene, 10%-65% as moles of α-olefin, 0%-10% as moles of diene, c) copolymers of ethylene with at least one $C_4$-$C_{12}$ α-olefin, and optionally a diene, having a density between 0.86 and 0.90 g/cm$^3$, or d) polypropylene modified with ethylene/$C_3$-$C_{12}$ α-olefin copolymers where the ratio by weight between polypropylene and the ethylene/$C_3$-$C_{12}$ α-olefin copolymer is between 90/10 and 30/70.

20. The method according to claim 1, wherein said protective element further includes at least one non-expanded polymeric layer coupled with said expanded polymeric layer.

21. The method according to claim 20, wherein said non-expanded polymeric layer has a thickness in the range of 0.2 to 1 mm.

22. The method according to claim 20, wherein said non-expanded polymeric layer is made of polyolefin material.

23. The method according to claim 20, wherein said non-expanded polymeric layer is in a position radially external to said expanded polymeric layer.

24. The method according to claim 23, wherein said protective element comprises a second non-expanded polymeric layer in a position radially internal to said expanded polymeric layer.

25. The method according to claim 1, comprising a further expanded polymeric layer in a position radially internal to said protective element.

26. The method according to claim 25, wherein said further expanded polymeric layer is in a position radially external to said insulating layer.

27. The method according to claim 25, wherein said further expanded polymeric layer is semiconductive.

28. The method according to claim 25, wherein said further expanded polymeric layer is water swellable.

29. The method according to claim 1, wherein said conductor is a metal rod.

30. The method according to claim 1, wherein said insulating layer is made of a non-crosslinked base polymeric material.

31. The method according to claim 1, wherein said selected voltage class belongs to a medium or high voltage range.

32. The method according to claim 1, wherein the protective element thickness has a value smaller than 7.5 m for a conductor cross-sectional area greater than 50 mm$^2$ and a value greater than 8.5 mm for a conductor cross-sectional area smaller than or equal to 50 mm$^2$.

33. The method according to claim 1, wherein said selected voltage class is higher than 60 kV and said impact is at least 70 J.

34. The method according to claim 1, wherein said selected voltage class is higher than 60 kV and said impact is at least 50 J.

35. The method according to claim 1, wherein said selected voltage class is not higher than 10 kV and said impact is at least 25 J.

36. The method according to claim 1, wherein said expanded polymeric layer has constant thickness.

37. The method according to claim 1, wherein said step of selecting a thickness of said protective element comprises the step of determining a thickness of said expanded polymeric layer.

38. The method according to claim 1, wherein said step of selecting a thickness of said protective element comprises the step of selecting a thickness of said expanded polymeric layer and determining a thickness of at least one non-expanded polymeric layer associated with said expanded polymeric layer, said protective element comprising said at least one non-expanded polymeric layer.

39. The method according to claim 38, wherein said step of determining a thickness of at least one non-expanded polymeric layer comprises the step of correlating in inverse relationship the thickness of said at least one non-expanded polymeric layer with the conductor cross-sectional area.

* * * * *